US006688733B1

(12) United States Patent
Huliba

(10) Patent No.: US 6,688,733 B1
(45) Date of Patent: Feb. 10, 2004

(54) RAPID PRESSURE RAMP STARTUP

(75) Inventor: David A. Huliba, Centerville, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 10/254,353

(22) Filed: Sep. 25, 2002

(51) Int. Cl.[7] ..... B41J 2/09
(52) U.S. Cl. ..... 347/76
(58) Field of Search ..... 347/73, 75, 76, 347/77

(56) References Cited

U.S. PATENT DOCUMENTS 4,122,458 A * 10/1978 Paranjpe ..... 347/77
4,250,510 A * 2/1981 Dressler ..... 347/76
4,514,735 A * 4/1985 Jones ..... 347/76
4,928,113 A * 5/1990 Howell et al. ..... 347/76
5,337,071 A * 8/1994 East et al. ..... 347/77
5,801,734 A * 9/1998 Schneider ..... 347/77
6,527,363 B1 * 3/2003 Bowling et al. ..... 347/36

* cited by examiner

*Primary Examiner*—Anh T. N. Vo
(74) *Attorney, Agent, or Firm*—Barbara Joan Haushalter

(57) ABSTRACT

A method is provided for transitioning from a lower pressure state to a final operating pressure state. Initially, an eyelid is used to divert ink into a fluid channel associated with the catcher assembly. Pressure of the ink is reduced to a low ink pressure level that will allow the ink to be removed by the fluid channel. Pressure of the ink is increased to at least one incremental step, before reaching a final ink operating pressure. A charge voltage is turned on to deflect ink into catch in a time interval short enough to prevent ink backup between the eyelid and the catcher assembly.

16 Claims, 3 Drawing Sheets

RAPID PRESSURE RAMP STARTUP

TECHNICAL FIELD

The present invention relates to continuous ink jet printing and, more particularly, to a startup sequence for a continuous ink jet printhead to transition from a lower pressure state to a final operating pressure state.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

In normal operation of the printhead, the charging electrodes deflect most of the ink drops, causing them strike the catcher face. The ink then flows down the catcher face and enters the catcher throat. Vacuum then draws the ink through the catcher outlet port back to the ink reservoir. In designing the catcher ink return path it is important that the return path provide uniform ink removal along the entire length of the catcher throat. U.S. Pat. No. 6,187,212, totally incorporated herein by reference, describes an exemplary ink removal geometry. The flow path described therein provides uniform vacuum along the entire length of the catcher throat while keeping the pressure drops in the flow path to a minimum.

During the automatic startup sequence of a continuous ink jet printhead, the fluid pressure to the ink jets can be anywhere from a low pressure where ink "weeps" from the droplet generator to the final operating pressure. By way of example, for the Versamark printhead, the startup sequence includes states where ink weeps at low pressure from the droplet generator, to help redissolve ink on the exterior of the orifice plate and on the charging electrodes; states where ink is jetted out of the droplet generator orifices at 8 psi to allow condensate cleaning and drying of the charge plate; and states where the ink pressure is at the operating pressure of 15 psi, prior to turning on the drop charging to deflect the droplets onto the catcher face.

During the startup sequence, eyelid means are then used to seal against the bottom of the catcher. The eyelid sealing means not only seal against the catcher, but they are also designed to divert the ink that is jetting from the drop generator into the catcher throat. It has been determined that this process of diverting the ink flow into the catcher throat by means of the eyelid has much higher fluid flow energy losses than the process of having the ink drops strike the catcher face and then flow into the catcher throat. As a result, a catcher ink return geometry that can effectively remove ink from the printhead when the drops are deflected into catch may have too much restriction to remove ink that is diverted into the catcher throat by the eyelid. This can result in ink filling the space between the eyelid and catcher and eventually in ink overflowing out of this space. Enlarging the cross section of the ink return path can reduce the flow restrictions sufficiently to remove the ink diverted into the throat by the eyelid. During normal operation however, the lowered flow restriction in the ink return line can result in excessive air being drawn into the catcher throat. This can result in excessive amounts of foam being generated in the catcher return line and in the ink tank.

A catcher ink return geometry has been developed for some printheads which could provide acceptable ink removal both while the ink is charged and deflected into catch and during the startup sequence when the ink is diverted into the catcher throat by the eyelid. It has been determined, however, that sharp transitions in flow rate, such as are produced by stepping the ink pressure from 8 psi to 15 psi, could result in ink overflowing the space between the eyelid and the catcher. Therefore, it has been necessary to slowly ramp up of the ink pressure to avoid the problems caused by sharp flow transitions.

In newer printheads designed for high print speeds, the ink flow rates are much higher than prior art printheads, presenting difficulties not heretofore encountered in the art. For example, the 165 kHz printhead, developed and manufactured by Scitex Digital Printing, Inc., in Dayton, Ohio, operates at 28 psi and up to 1300 ml/min flow rate. The pressure is 87% higher and the flow rate is 73% more than in previous printheads. At such flow rates, it is not possible to adjust the catcher geometry to facilitate proper ink removal both when the ink drops are deflected into catch and when the ink must be diverted into the catcher throat by the eyelid. The catcher ink return fluid restrictions do not allow for adequate ink removal during startup states when the ink must be diverted into the catcher throat by the eyelid and the ink pressure is at the normal operating pressure. This results in ink overflowing the space between the eyelid and the catcher It would be desirable, therefore, to be able to transition from a lower pressure state to a final operating pressure state without encountering the problems associated with the prior art.

SUMMARY OF THE INVENTION

The ink return problem finds its solution in the rapid pressure ramp of the ready startup cycle of the printhead, in accordance with the present invention. During the startup sequence when the eyelid must be used to divert the ink into the catcher throat, the ink pressure is kept below its normal level. This reduces the flow rate sufficiently to allow the ink to be adequately removed by the catcher ink return path. The ink pressure is then increased to the normal operating pressure and the charge voltage turned on to deflect the drops into catch in a time interval that is short enough to prevent the backup of ink in the printhead, between the eyelid and catcher.

In accordance with one aspect of the present invention, a method is provided for transitioning from a lower pressure state to a final operating pressure state. Initially, an eyelid is used to divert ink into a fluid channel associated with the catcher assembly. Pressure of the ink is reduced to a low ink pressure level that will allow the ink to be removed by the fluid channel. Pressure of the ink is increased to at least one incremental step, before reaching a final ink operating pressure. A charge voltage is turned on to deflect ink into catch in a time interval short enough to prevent ink backup between the eyelid and the catcher assembly.

Other objects and advantages of the invention will be apparent from the following description, the accompanying drawings and the appended claims.

DETAILED DESCRIPTION OF THE PREFERRED EMBODIMENTS

Figure 1:
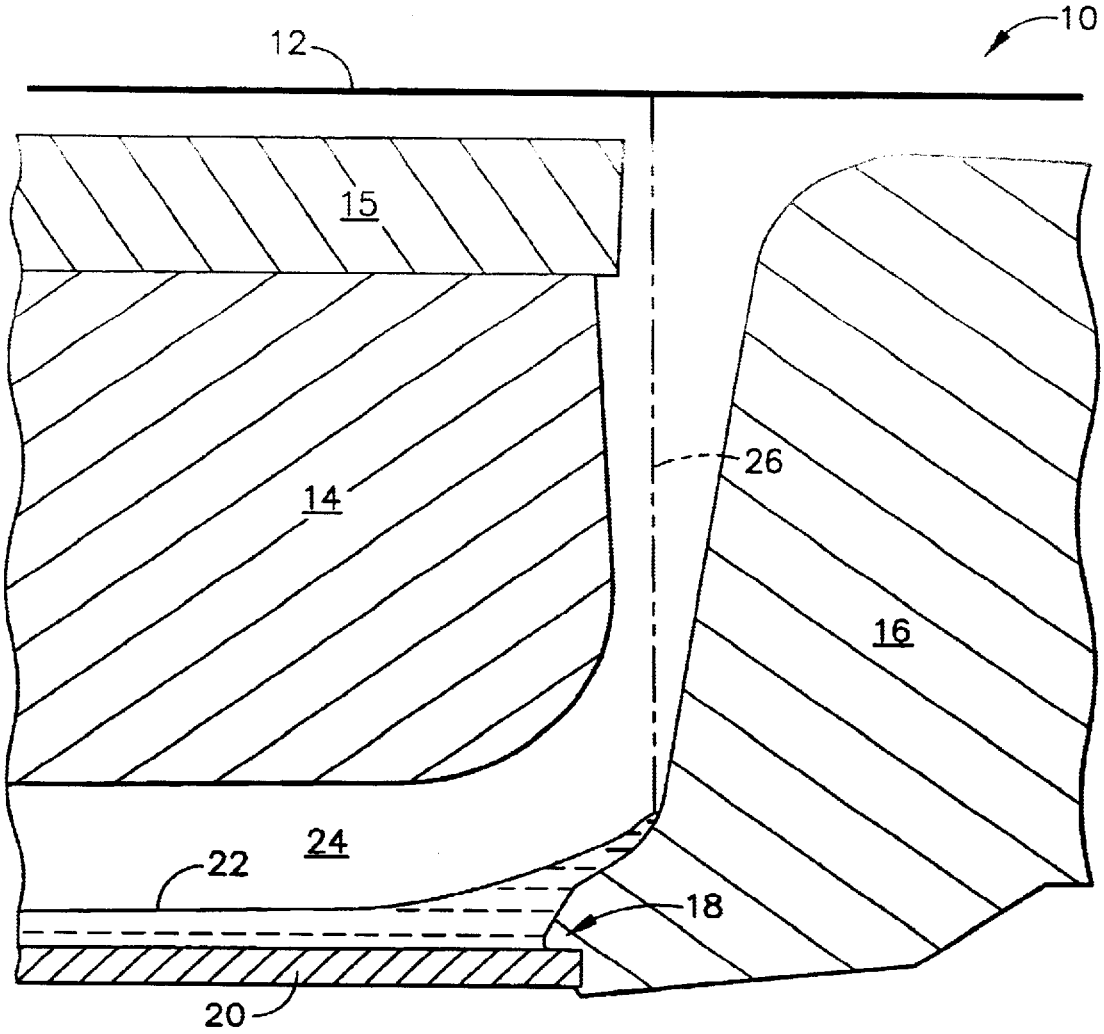
FIG. 1 (PRIOR ART)
FIG. 1 is a prior art side view of a printhead, illustrating the trajectory flow of uncharged ink droplets, with the eyelid closed.

Referring to FIG. 1, there is illustrated a prior art view of a drop generator and catcher assembly 10. A drop generator 12 is situated in an area above a catcher 14 and charge plate 15, and an eyelid 16. When the eyelid is in the open position, ink drops are allowed to exit the printhead. When the eyelid is moved to the closed position, as shown in FIG. 1, the eyelid seal 18 presses against the bottom edge of the catcher plate 20 to contain ink 22 within the printhead on startup and shutdown of the printer system. The uncharged ink droplets flow along a trajectory path indicated by 26 in FIG. 1. During the startup sequence when the eyelid must be used to divert the ink into the catcher throat or fluid channel 24, the ink pressure is kept below its normal level. This reduces the flow rate sufficiently to allow the ink to be adequately removed by the catcher ink return path. The ink pressure is then increased to the normal operating pressure and the charge voltage turned on to deflect the drops into catch in a time interval that is short enough to prevent the backup of ink in the printhead, between the eyelid and the catcher.

In the startup sequence for continuous ink jet printers, the final operating pressure state is normally higher than previous startup pressure steps. For example, in the 110 kHz Versamark printer, from Scitex Digital Printing, Inc., the final operating pressure is about 15 psi, while during the earlier states in the startup sequence the ink pressure is at 8 psi or less. During the startup sequence, the eyelid means that seals against the catcher diverts the ink into the catcher. It has been determined that this process of diverting the ink flow into the catcher throat by means of the eyelid has much higher fluid flow energy losses than the process of having the ink drops strike the catcher face and then flow into the catcher throat. As a result, there is some critical ink pressure $P_{dv}$ at or above which the ink return lines cannot adequately remove ink from the printhead, when the ink is diverted into the catcher by the eyelid. This pressure $P_{dv}$ is below the critical pressure $P_{cat}$, at or above which ink deflected into catch by the drop charging and deflection process cannot be adequately removed from the printhead.

In prior art printers, such as the aforementioned 110 kHz Versamark, the ink removal threshold pressure Pdv was above the normal operating pressure of the printhead. As such, there was adequate removal of the ink from the printhead even when the ink pressure was raised to the operating pressure prior to turning on the charge voltage.

Figure 2A:
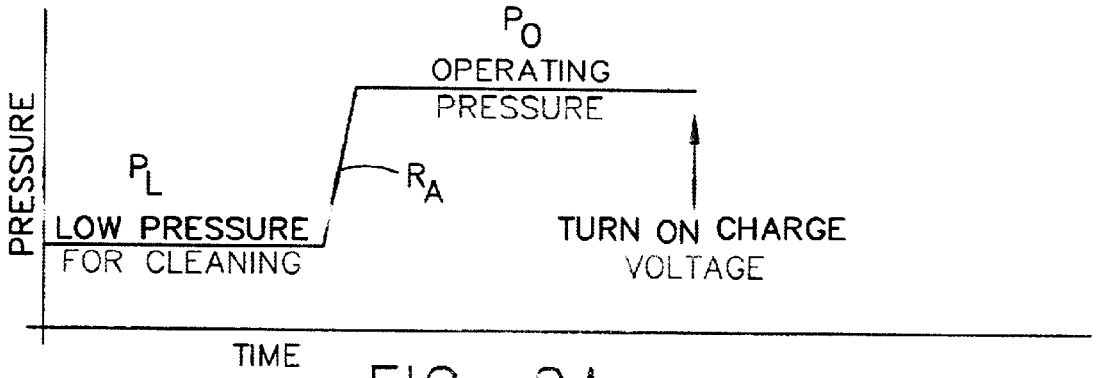
FIG. 2A (PRIOR ART)
FIGS. 2A and 2B illustrate prior art pressure ramping sequences.

It has been determined, however, that sharp transitions in flow rate, such as are produced by stepping the ink pressure from 8 psi to 15 psi, could result in ink overflowing the space between the eyelid and the catcher. Such a sharp transition is shown in FIG. 2A. To overcome that problem, a slow pressure ramp, such as is shown in FIG. 2B, can be implemented.

The new 165 kHz printhead, developed and manufactured by Scitex Digital Printing, Inc., in Dayton, Ohio, to provide higher print speeds than the 110 kHz Versamark printer, operates at 28 psi and up to 1300 ml/min flow rate. The pressure is 87% higher and the flow rate is 73% more than in previous printheads. It was possible to modify the catcher flow geometry, in keeping with the teachings of the '212 patent to handle these flow rates. That is, with the modified catcher flow geometry, it was possible to raise the critical pressure Pcat above the normal operating pressure. The flow restrictions present when ink is diverted into the catcher by the eyelid, however, preclude adequate ink removal in that condition at the operating pressure. That is, the ink removal threshold pressure Pdv is below the operating pressure for the new printhead. When the ink pressure exceeds the ink removal threshold pressure Pdv, ink will overflow the containment area determined by the boundaries of the eyelid seal and catch pan and catcher assembly of the printhead and drip. Once the droplets have a charge voltage applied and are deflected onto the catcher surface, the fluid flow restraints are minimized as the pressure losses in the catcher flow channels are reduced.

Figure 2B:
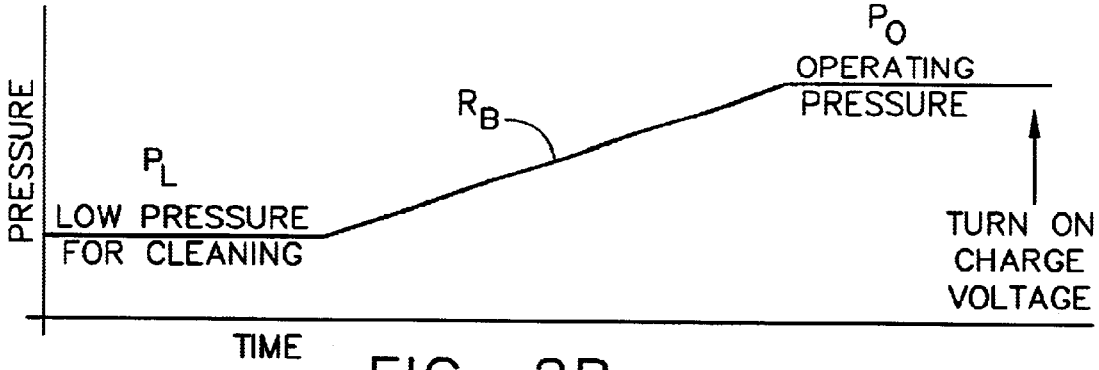
FIG. 2B (PRIOR ART)

Referring now to FIGS. 2A and 2B, the prior art has attempted to ramp to a final operating pressure using various techniques. In FIGS. 2A and 2B, pressure is shown by the vertical axis, ramping from a low pressure state at $P_L$ to a final operating pressure at $P_O$. In FIG. 2A, the final operating pressure is achieved by applying a very fast step, at ramp increase $R_A$. However, this approach was found to have problems with ink overflowing the containment volume in the 110 kHz printer, where the ink removal threshold pressure Pdv was above the normal operating pressure. In FIG. 2B, a slow ramp up increase, indicated by $R_B$, is applied to reach the final operating pressure. While this worked appropriately for the 110 kHz printhead, it does not work with the higher flow rate 165 kHz printhead. The long ramp up to operating pressure, as illustrated in FIG. 2B, has the disadvantage of allowing the pressure to exceed the ink removal threshold pressure Pdv for too long before charge voltage is applied.

Figure 3:
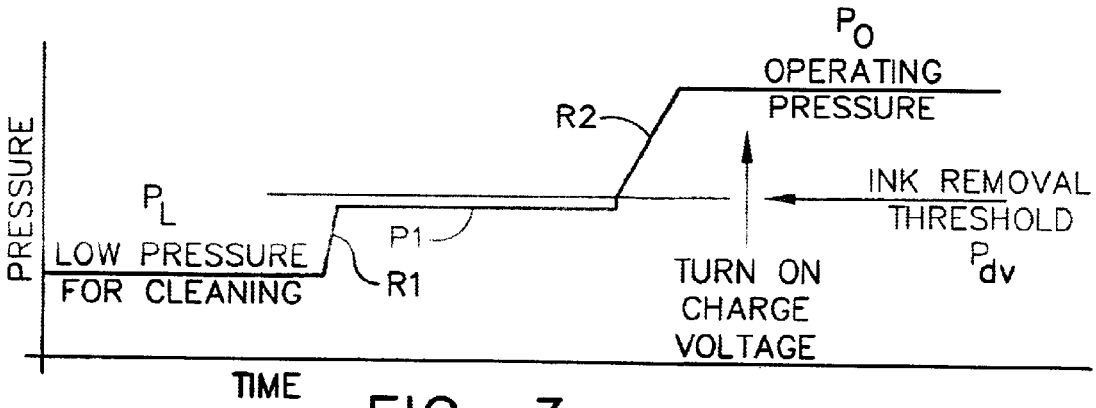
FIG. 3 illustrates the pressure ramping sequence in accordance with the present invention.
Figure 4:
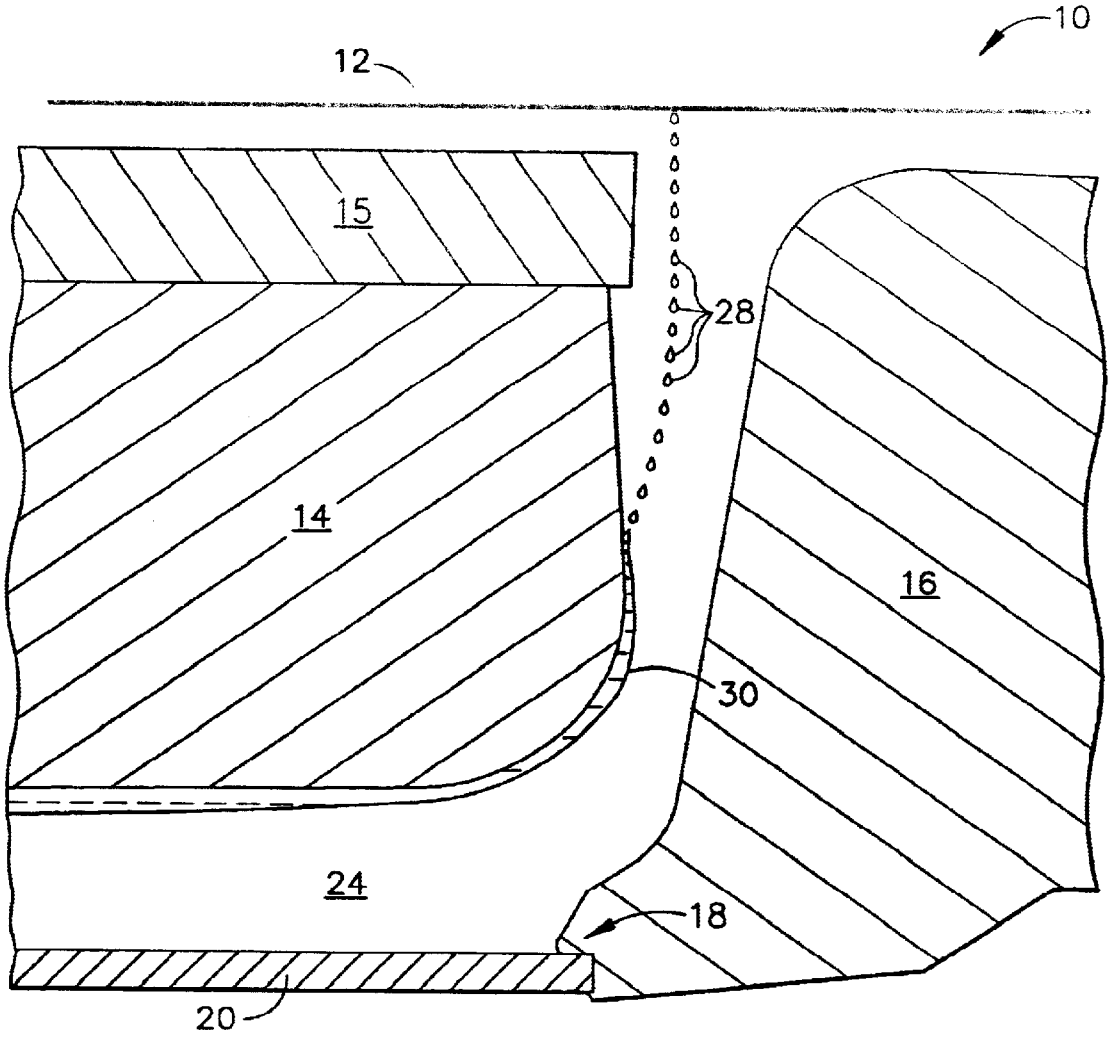
FIG. 4 is a side view of the printhead, illustrating the charged ink droplets being electrostatically deflected onto the catcher face, to rapidly flow around the radius of the catcher into the catcher throat.

In accordance with the present invention, therefore, a stepped pressure ramp up is applied, as illustrated in FIG. 3, to go from a low pressure $P_L$ to the final operating pressure $P_O$, and allow for the charge voltage to be turned on. A series of smaller pressure jumps are applied, as indicated by the pressure jump at R1, followed by an stabilizing pressure period at P1, followed by a subsequent pressure jump at R2. The stabilizing pressure period at P1 is just below the ink removal threshold pressure Pdv. By stabilizing the ink pressure just below the ink removal threshold pressure Pdv, reduces the need for a sharp pressure transition as was employed in FIG. 2*a*, while avoiding the long time intervals with the pressure above the ink removal threshold pressure Pdv that was characteristic of FIG. 2*b*. From this intermediate pressure just below Pdv, the pressure can be fairly quickly stepped up to the operating pressure. Almost simultaneously with this increase in pressure to the operating pressure, the charge voltage is applied to deflect the droplets 28 onto the catcher surface, as illustrated in FIG. 4. The ink 30 then flows around the catcher radius and enters the fluid channel 24. This flow path has much lower pressure drops associated with it, allowing the catcher flow channel to more readily remove ink from the printhead. As a result, the catcher flow channel can now handle the high ink flow that is produced by the increase in the pressure to the operating pressure, without causing the space between the eyelid and catcher to overflow. The series of pressure jumps from a lower pressure to the final operating pressure, while applying the charge voltage before the final operating pressure is achieved, has proven successful for the startup sequence of high pressure and high flow rate printheads, allowing the sequence to proceed through a fluid overflow threshold without failure.

By way of exemplary application of the present invention, during the startup sequence, the new high flow rate printhead performs the condensate cleaning of the charge plate at, for example, 20 psi and has an operating pressure of, for example, 28 psi. Rather than step or ramp the pressure control setpoint up from the 20 psi to the 28 psi as was done in the prior art, the present invention steps the pressure control setpoint up from 20 psi to, for example, 24 psi. It has been observed that maintaining pressures above 24 psi will lead to ink overflowing the eyelid. The 24 psi condition therefore defines a critical ink removal threshold at or below which the ink removal rate through the catcher will prevent ink overflow. The printhead can remain in this 24 psi state, indicated in FIG. 3 as state P1, for extended periods of time, allowing the fluid control servos to stabilize without risk of ink overflowing the eyelid. In one embodiment, the fluid system remains in this state at least 10 seconds before progressing to the next state. Stabilizing the pressure at state P1, or the exemplary 24 psi, reduces the step size required to reach the final operating point. This allows the subsequent step up to the final operating pressure to be more readily achieved, with quicker response and less overshoot. Having allowed the fluid system to stabilize at 24 psi, the pressure control setpoint can subsequently be stepped up to 28 psi. Then, before the fluid system can stabilize at 28 psi, the charge voltage is turned on to deflect the ink drops into catch. As mentioned earlier, deflecting the ink drops into catch makes the ink removal process more efficient, so that ink can be removed by the catcher at higher flow rates. By deflecting drops into catch even before the pressure has stabilized at 28 psi, the more efficient ink removal process can take effect before the increased flow rates can result in an overflow condition.

In one preferred embodiment, the pressure ramp rate for the transition from 24 psi, which is just below the ink removal threshold Pdv, to the operating pressure of 28 psi, is modified by inserting a two second state having a target pressure, or pressure setpoint, of 26 psi. Since the response rate for the pressure servo is greater than 2 seconds, the insertion of this state in the startup sequence serves to reduce actual rate of pressure increase. It does not cause the pressure to actually be held at 26 psi for any extended length of time. Approximately three seconds after reaching the final operating pressure, the charge voltage is turned on. These state times at the two target pressures are much less than the 8 seconds normally required for the fluid system to stabilize at a new pressure.

While it has been noted that the charge voltage is turned on well before the pressure has stabilized at the desired operating pressure, it must also be recognized that charge voltage is not turned on concurrently with the change in pressure setpoint. Rather, the setpoint is changed and thereafter the charge voltage is turned on. This small delay in turning on the charge voltage is sufficient to allow the pressure to begin rising to the operating pressure, but not stabilize there. If the delay time is too short, the ink pressure may be too low, resulting in excess drop deflection that can cause a shorting condition of the charge plate. Conversely, too long of a delay time will result in the ink pressure being above the critical ink removal threshold long enough to cause ink to overflow the space between the eyelid and catcher.

When the charge voltage is turned on, a voltage lower than the normal operating charge voltage is used. This initial charge voltage should be sufficient to deflect the ink drops into catch. It also should be low enough that it will not cause charge plate shorts. Charge plate shorts can occur at normal operating charge voltages as the drop deflection will vary up and down in response to the initially varying ink pressure. Increasing the drop deflection above its normal level can cause the ink drops to be deflected into the charge plate, where they can produce shorting conditions. The selection of the proper charge voltage to initially use in order to deflect the ink drops into catch is described in commonly assigned, co-pending application Ser. No. 10/254,354, totally incorporated herein by reference.

By setting the pressure setpoint or target pressure at or below the critical ink removal rate, but above the initial pressure, the pressure step size is reduced. Reducing the step size speeds up the actual transition time. The approach of the present invention also reduces the amplitude of overshoot and oscillation at the new pressure, thereby reducing the risk of drop deflection variations that could cause charge plate shorts. With the pressure transition of the present invention, wherein one or more intermediate pressure ramp up states are applied prior to reaching the final operating pressure, it is permissible to overshoot or undershoot the actual pressure at the intermediate step(s) without incurring the adverse effects that can occur without the intermediate step(s).

Having described the invention in detail and by reference to the preferred embodiment thereof, it will be apparent that other modifications and variations are possible without departing from the scope of the invention defined in the appended claims.

What is claimed is:

1. A startup sequence for a continuous ink jet printer, the printer having a catcher assembly, a method for transitioning from a lower pressure state to a final operating pressure state, the method comprising the steps of:

using an eyelid to divert ink into a fluid channel associated with the catcher assembly;

reducing pressure of the ink to a low ink pressure level that will allow the eyelid diverted ink to be removed by the fluid channel;

increasing pressure of the ink to an ink operating pressure;

turning on a charge voltage to deflect ink into catch in a time interval short enough to prevent ink backup between the eyelid and the catcher assembly.

2. A method for transitioning as claimed in claim 1 further comprising the step of setting a pressure control setpoint that is initially below the ink operating pressure and a critical ink removal rate that is less than the flow rate required to backup fluid between the eyelid and the catcher assembly.

3. A method for transitioning as claimed in claim 2 wherein the step of setting the pressure control setpoint further comprises the step of setting the pressure control setpoint at or below the critical ink removal rate, and above an initial pressure.

4. A method for transitioning as claimed in claim 2 further comprising the step of first incrementing the pressure control setpoint to a pressure approximately half way between the low ink pressure level and the ink operating pressure.

5. A method for transitioning as claimed in claim 4 further comprising the step of maintaining the low ink pressure level for a predetermined time that is sufficient to ensure that pressure has stabilized at said level before incrementing to the ink operating pressure.

6. A method for transitioning as claimed in claim 4 further comprising the step of maintaining the low ink pressure level for at least ten seconds before incrementing to the ink operating pressure.

7. A method for transitioning as claimed in claim 1 wherein the step of turning on the charge voltage further comprises the step of turning on the charge voltage for approximately three seconds, initiating a command to change pressure to the operating pressure.

8. A method for transitioning as claimed in claim 1 wherein the step of turning on the charge voltage further comprises the step of turning on an initial charge voltage lower than an operating charge voltage.

9. A method for transitioning as claimed in claim 8 wherein the initial charge voltage is sufficient to deflect ink drops into catch.

10. A method for transitioning as claimed in claim 8 wherein the initial charge voltage is low enough that it will not cause charge plate shorts.

11. A method for transitioning as claimed in claim 1 wherein the step of increasing the ink pressure comprises the step of applying at least one intermediate pressure ramp up state prior to reaching the ink operating pressure.

12. A startup method for a continuous ink jet printer, having a drop generator, a catcher assembly and an eyelid, all associated with a fluid system, for use during startup to divert ink into flow channels of the catcher assembly, the method comprising the steps of:

determining an ink pressure threshold to the drop generator above which ink jetting from the drop generator and diverted into the flow channels of the catcher assembly can not be adequately removed by the flow channels of the catcher assembly;

increasing pressure to at least one intermediate pressure state that is at or slightly below the determined ink pressure threshold, during the startup sequence;

allowing the fluid system to stabilize at the at least one intermediate pressure state;

increasing pressure to a final operating pressure state; and turning on a charge voltage to deflect ink drops into catch after a time interval long enough to allow the pressure to start to rise to the final operating pressure, but not long enough to allow the pressure to stabilize at the final operating pressure.

13. A startup method as claimed in claim 12 wherein the step of turning on the charge voltage further comprises the step of turning on the charge voltage approximately three seconds after after initiating a command to reach the final operating pressure state.

14. A startup method as claimed in claim 12 wherein the step of turning on a charge voltage further comprises the step of turning on an initial charge voltage lower than an operating charge voltage.

15. A startup method as claimed in claim 14 wherein the initial charge voltage is sufficient to deflect ink drops into catch.

16. A startup method as claimed in claim 14 wherein the initial charge voltage is low enough that it will not cause charge plate shorts.

* * * * *